US011859462B2

(12) United States Patent
Arabskyy et al.

(10) Patent No.: US 11,859,462 B2
(45) Date of Patent: Jan. 2, 2024

(54) BOTTOM HOLE ASSEMBLY AND METHODS FOR COMPLETION

(71) Applicant: INTERRA ENERGY SERVICES LTD., Calgary (CA)

(72) Inventors: Serhiy Arabskyy, Beaumont (CA); Andrew Barabash, Edmonton (CA)

(73) Assignee: INTERRA ENERGY SERVICES LTD., Calgary (CA)

( * ) Notice: Subject to any disclaimer, the term of this patent is extended or adjusted under 35 U.S.C. 154(b) by 662 days.

(21) Appl. No.: 17/051,371

(22) PCT Filed: Apr. 25, 2019

(86) PCT No.: PCT/CA2019/050535

§ 371 (c)(1),
(2) Date: Oct. 28, 2020

(87) PCT Pub. No.: WO2019/210398

PCT Pub. Date: Nov. 7, 2019

(65) Prior Publication Data

US 2021/0047896 A1 Feb. 18, 2021

(30) Foreign Application Priority Data

May 1, 2018 (CA) ..... 3003706

(51) Int. Cl.

| | |
|---|---|
| ***E21B 33/129*** | (2006.01) |
| ***E21B 33/12*** | (2006.01) |
| ***E21B 34/14*** | (2006.01) |

(52) U.S. Cl.
CPC ..... *E21B 33/1294* (2013.01); *E21B 33/1291* (2013.01); *E21B 34/14* (2013.01); *E21B 2200/06* (2020.05)

(58) Field of Classification Search
None
See application file for complete search history.

(56) References Cited

U.S. PATENT DOCUMENTS

| | | | | |
|---|---|---|---|---|
| 8,393,392 | B2 * | 3/2013 | Mytopher | E21B 43/1185 166/299 |
| 2015/0129197 | A1 * | 5/2015 | Andreychuk | E21B 43/26 166/123 |

FOREIGN PATENT DOCUMENTS

| | | | |
|---|---|---|---|
| CA | 2890057 | A1 | 5/2014 |
| CA | 2871318 | A1 | 5/2015 |
| WO | 2014/175890 | A1 | 10/2014 |
| WO | 2019/040231 | A1 | 2/2019 |

OTHER PUBLICATIONS

CA 2738907 Getzlaf et al. Jul. 12, 2011 (Year: 2011).*
International Search Report issued by the Canadian Intellectual Property Office dated Jul. 24, 2019 in connection with International Patent Application No. PCT/CA2019/050535, 4 pages.

(Continued)

*Primary Examiner* — Charles R Nold

(57) ABSTRACT

The present disclosure is generally directed to a bottom hole assembly. The bottom hole assembly may include a by-pass valve assembly and a shifting tool assembly positioned downhole from the by-pass valve assembly. The bottom hole assembly may used to hydraulically fracture a wellbore and shift a well tool from a first position to a second position within the wellbore.

20 Claims, 14 Drawing Sheets

(56) References Cited

OTHER PUBLICATIONS

Written Opinion of the International Searching Authority issued by the Canadian Intellectual Property Office dated Jul. 24, 2019 in connection with International Patent Application No. PCT/CA2019/050535, 5 pages.

* cited by examiner

BOTTOM HOLE ASSEMBLY AND METHODS FOR COMPLETION

CROSS-REFERENCE TO RELATED APPLICATIONS

The present application is a National Phase of International Application PCT/CA2019/050535 filed on Apr. 25, 2019, which designated the United States, and which claims foreign priority to Canadian Patent Application Serial No. 3,003,706 filed on May 1, 2018. The entire contents of the aforementioned applications are incorporated by reference herein.

FIELD

The present disclosure generally relates to an assembly for use in oil and gas wells, and in particular, to a bottom hole assembly which may include a by-pass valve assembly, a packer assembly, a drag-slip assembly and a shifting tool assembly for use in a subterranean formation containing fluids.

BACKGROUND

Downhole oil and gas production operations, and particularly those in multi-stage vertical or horizontal wells, require the stimulation and production of one or more zones of a hydrocarbon bearing formation. In some instances, this can be done by running a liner or casing including ported sleeves or collars, downhole at spaced intervals along the wellbore. The location of these downhole tools is commonly set to align with the formation zones to be stimulated. The downhole tool must then be manipulated in order to be opened or closed as required. In some cases, this can be achieved by running a bottom hole assembly down through the liner or casing.

Generally, the bottom hole assembly is run on a work string, such as coiled tubing or jointed tubing, inside the liner or casing for the purposes of locating/interacting with the downhole tool adjacent the formation zone to be treated. Once located near or inside the downhole tool, the bottom hole assembly typically engages against the downhole tool or against the casing near the downhole tool, and the bottom hole assembly is either manipulated mechanically or hydraulically thereby manipulating the downhole tool as required. Fluids, which can contain abrasive materials, are then passed through the liner or casing string and injected into the oil-bearing formation at high flow rates to treat the formation.

A common problem associated with conventional bottom hole assemblies is the high velocity flow used during treatment will damage and/or destroy the bottom hole assembly over time. For example, it is not uncommon to position tools of the bottom hole assembly, such as a shifting tool, above the bottom hole assembly's treatment port. When fluids are then moved through the bottom hole assembly at high flow rates during treatment, the tools positioned above the treatment, like the shifting tool, will either erode over time or be prevented from operating properly due to contamination. To control such erosion or prevent contamination, well operators will often limit the flow rate during treatment. However, decreasing the flow rate will decrease the effectiveness of the treatment resulting in a less than optimal treatment and a corresponding reduction in hydrocarbon production. Accordingly, it would be desirable to improve upon state of the art bottom hole assemblies in order to overcome, or at least reduce, the above described detrimental effects.

SUMMARY

According to one embodiment, there is provided a bottom hole assembly adapted for connection to a tubing string, the bottom hole assembly comprising: (a) a by-pass valve assembly comprising an up-hole end adapted for fluid communication with fluid flowing in a tubing string, a downhole end and a first flow passage extending between the up-hole end and the downhole end of the by-pass assembly, and further comprising at least one port for fluid communication between the first flow passage and an annular area exterior of the bottom hole assembly; (b) a resettable sealing assembly positioned downhole of the by-pass valve assembly and comprising an up-hole end, a downhole end and a second flow passage there between; and (c) a shifting tool assembly positioned downhole of the resettable sealing assembly and comprising an up-hole end, a downhole end and a third flow passage there between; wherein the by-pass valve assembly is operable to direct fluid flow in a first mode of operation and a second mode of operation; wherein in said first mode of operation fluid flow is directed from the first flow passage to the annular area exterior of the bottom hole assembly through the port and is not directed from the first flow passage to the second flow passage in the resettable sealing assembly; and wherein in said second mode of operation fluid flow is prevented from flowing from the first flow passage to the annular area exterior of the bottom hole assembly through the port and is directed from the first flow passage to the second flow passage in the resettable sealing assembly.

According to another embodiment, there is provided a bottom hole assembly comprising: (a) an upper end and a lower end and a fluid flow passage there between; (b) a valve; (c) a packing element and an anchor slip each positioned downhole of the valve; and (d) a shifting tool located downhole of the packing element and anchor slip, wherein the valve is operable to direct fluid flow entering the upper end of the bottom hole assembly to: (i) an area exterior of the bottom hole assembly through a port positioned uphole from the packing element and anchor slip in a first valve orientation; or (ii) to the shifting tool in a second valve orientation.

In still another embodiment, there is provided a bottom hole assembly for performing an operation in a wellbore, comprising: (a) a port and a resettable sealing assembly for performing a wellbore fracking operation; (b) a shifting tool for performing a shifting operation wherein the shifting tool is located downhole of the port and the resettable sealing assembly; and (c) a valve operable to direct fluid flow to the port or the shifting tool, wherein the bottom hole assembly is operable to perform the wellbore fracking operation and the shifting operation while the bottom hole assembly is deployed in the wellbore.

In a further embodiment, there is provided a bottom hole assembly adapted for connection to a tubing string, the bottom hole assembly comprising: (a) a by-pass valve assembly comprising an up-hole end adapted for fluid communication with fluid flowing in a tubing string, a downhole end and a first flow passage extending between the up-hole end and the downhole end of the by-pass assembly, and further comprising at least one port for fluid communication between the first flow passage and an annular area exterior of the bottom hole assembly; and (b) a resettable sealing assembly positioned downhole of the by-pass valve assembly and comprising an up-hole end, a downhole end and a second flow passage there between; wherein the by-pass valve assembly is operable to direct fluid flow in a first mode of operation and a second mode of operation; wherein in said first mode of operation fluid flow is directed from the first flow passage to the annular area exterior of the bottom hole assembly through the port and is not directed from the first flow passage to the second flow passage in the resettable sealing assembly; and wherein in said second mode of operation fluid flow is prevented from flowing from the first flow passage to the annular area exterior of the bottom hole assembly through the port and is directed from the first flow passage to the second flow passage in the resettable sealing assembly.

In still another embodiment, there is provided a well system comprising: (a) a completion string deployed within the wellbore and comprising one or more well tools, wherein at least one of the well tools is shiftable between two or more configurations; (b) a bottom hole assembly positioned within the completion string and coupled to a deployment mechanism, the bottom hole assembly comprising: (i) a by-pass valve assembly comprising a valve; (ii) a resettable sealing assembly located downhole from the by-pass valve assembly and comprising a packing element and an anchor slip; and (iii) a shifting tool assembly located downhole from the resettable sealing assembly and comprising a shift key operable to radially expand from the shifting tool assembly and grip a surface of the well tool to shift the well tool from a first position to a second position and a flow restriction device positioned downhole of the shift key.

According to another embodiment, there is provided an assembly of downhole tools comprising: a first tool, a second tool and a third tool wherein the first tool comprises a by-pass valve assembly in fluid communication with the second tool and the second tool comprises a resettable sealing assembly in fluid communication with the third tool and the third tool comprises a shifting tool assembly and further wherein the first tool is positioned above the second tool and the second tool is positioned above the third tool.

In another embodiment, there is provided a well completion apparatus for treating a wellbore and shifting a well tool in a single trip comprising: (a) an upper end comprising an outer sleeve having one or more ports in its sidewall, a housing having one or more openings and operable to slide axially relative to the outer sleeve to align the one more ports with the one or more openings, a valve positioned within the housing and moveable between an open position and a closed position and an annular channel; (b) a packer assembly positioned below and in fluid communication with the upper end and operable to form a seal and isolate a portion of the wellbore above the packer assembly from a portion of the wellbore below the packer assembly; (c) a lower end positioned below and in fluid communication with the packer assembly comprising a shifting tool operable to shift a well tool; and (d) a tubing string in fluid communication with the upper end, wherein when the well completion apparatus is deployed in a wellbore and the valve is in an open position and the packing assembly is in a set position forming a seal, the one or more openings and one or more ports are aligned and a fluid entering the apparatus through the tubing string exits through the one or more ports and one more openings to treat the wellbore, and when the valve is in a closed position, the one or more ports and one or more openings are not aligned the fluid entering the apparatus through the tubing string exits through the one or more openings and into the annular channel and past the one or more ports and to the lower end to activate the shifting tool to shift the well tool.

In a further embodiment, there is provided a bottom hole assembly operable in at least four configurations comprising: (a) a by-pass valve assembly comprising one or more ports, one or more openings and a valve; (b) a resettable sealing assembly located below the by-pass valve assembly comprising a packing element and an anchor slip; and (c) a shifting tool assembly located below the resettable sealing assembly comprising a shift key wherein the bottom hole assembly is movable between the at least four configurations either hydraulically or by application of tension or compression to the bottom hole assembly.

According to another embodiment, there is provided a method of treating a wellbore with a bottom hole assembly of the present disclosure coupled to and in fluid communication with a tubing string comprising: (a) locating the bottom hole assembly adjacent to at least one of a plurality of ported tubulars along a completion string or casing located within the wellbore, the ported tubular having at least one closed port and configured to permit selective treatment of the wellbore; (b) transferring a first fluid from a surface through the tubing string to activate the shifting tool assembly to engage the ported tubular; (c) moving the bottom hole assembly upwards or downwards by pulling or pushing on the tubing string to shift the port from a closed position to an open position; (d) reducing flow of the first fluid to deactivate the shifting tool assembly; (e) moving the bottom hole assembly down by pushing on the tubing string to set the resettable sealing assembly to form a seal between an outer surface of the bottom hole assembly and outer wall of the ported tubular; and (f) transferring a treatment fluid from the surface through the tubing string and through the port of the by-pass valve assembly to the opened port of the ported tubular to treat the wellbore.

In an additional embodiment, there is provided a method for performing a wellbore operation with the bottom hole assembly of the present disclosure coupled to and in fluid communication with a tubing string and located in a wellbore adjacent to a ported tubular having at least one closed port comprising: (a) transferring a first fluid from a surface through the tubing string to create a differential pressure at the lower end of the shifting tool assembly thereby expanding a shift key radially outward to engage the ported tubular; and (b) moving the bottom hole assembly upwards or downwards by pulling or pushing on the tubing string to shift the port from a closed position to an open position.

In an another embodiment, there is provided a method for performing a wellbore operation with the bottom hole assembly of the present disclosure coupled to and in fluid communication with a tubing string and located in a wellbore adjacent to a ported tubular having at least one open port comprising: (a) moving the bottom hole assembly down by pushing on the tubing string to set the resettable sealing assembly to form a seal between an outer surface of the bottom hole assembly and an outer wall of the ported tubular; and (b) transferring a treatment fluid from the surface through the tubing string and through the port of the by-pass valve assembly to the opened port of the ported tubular to treat the wellbore.

In still yet another embodiment, there is provided a method of cycling the bottom hole assembly of the present disclosure connected to and in fluid communication with a tubing string at an upper end of the bottom hole assembly through at least four configurations comprising: (a) pulling up on the tubing string or pushing down on the tubing string to configure the bottom hole assembly in a first configuration; (b) pulling up on the tubing string and pumping a first fluid through the tubing string and the bottom hole assembly to configure the bottom hole assembly in a second configuration; (c) pulling up on the tubing string or pushing down on the tubing string to cycle an auto-J mechanism to a position such that the anchor slip can slide axially and then pushing down on the tubing string to configure the bottom hole assembly in a third configuration; and (d) pulling up on the bottom hole assembly to configure the bottom hole assembly in a fourth configuration.

DETAILED DESCRIPTION

Figure 1:
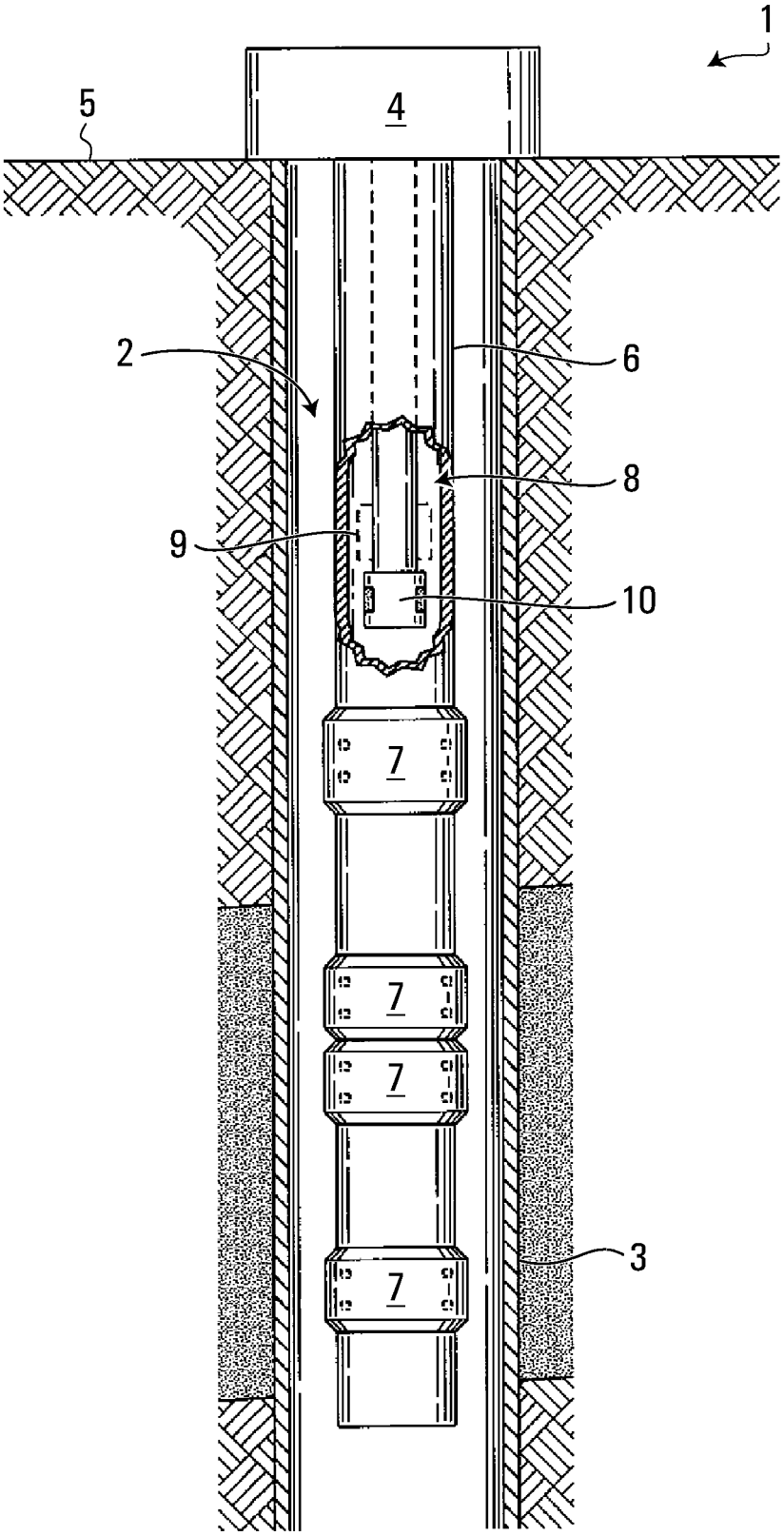
FIG. 1 depicts a well system containing a bottom hole assembly.

If appearing herein, the term "comprising" and derivatives thereof are not intended to exclude the presence of any additional component, step or procedure, whether or not the same is disclosed herein. In order to avoid any doubt, all compositions claimed herein through use of the term "comprising" may include any additional additive, adjuvant, or compound, unless stated to the contrary. In contrast, the term, "consisting essentially of" if appearing herein, excludes from the scope of any succeeding recitation any other component, step or procedure, except those that are not essential to operability and the term "consisting of", if used, excludes any component, step or procedure not specifically delineated or listed. The term "or", unless stated otherwise, refers to the listed members individually as well as in any combination.

The articles "a" and "an" are used herein to refer to one or to more than one (i.e. to at least one) of the grammatical objects of the article. By way of example, "a seal" means one seal or more than one seal. The phrases "in one aspect", "according to one aspect" and the like generally mean the particular feature, structure, or characteristic following the phrase is included in at least one embodiment of the present disclosure, and may be included in more than one embodiment of the present disclosure. Importantly, such phrases do not necessarily refer to the same embodiment. If the specification states a component or feature "may", "can", "could", or "might" be included or have a characteristic, that particular component or feature is not required to be included or have the characteristic.

As used herein, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. However, when applied to equipment and methods for use in environments that are deviated or horizontal, such terms may refer to a left to right, right to left, or other relationship as appropriate.

Any reference to the term "uphole" means a segment of the wellbore located along the wellbore between a recited location of the wellbore and the point at which the wellbore meets the surface of the earth. Although the term "uphole" can imply reference to locations closer to the surface than the recited point or location, those skilled in the art will appreciate that it can refer to locations further away from the earth's surface if the well bore includes U-shaped portions, which for example may return to a higher elevation.

Any reference to the term "downhole" means a segment of the wellbore located along the wellbore further into or further along the wellbore than the recited point or location. Although the term "downhole" can imply reference to locations further below the surface than the recited point or location, those skilled in the art will appreciate that it can refer to locations closer to the surface if the well bore includes U-shaped or similar segments, where for example the wellbore may run closer to the surface after having traversed wellbore sections further below the ground.

A "well" can include, without limitation, an oil, gas, or water production well, an injection well, or a geothermal well and which includes at least one wellbore.

The term "wellbore" and variations thereof, as used herein, refers to a cased or uncased hole drilled into the earth's surface to explore or extract natural materials, including water, gas and oil. The wellbore can include vertical, inclined, and horizontal portions, and it can be straight, curved, or branched.

The terms "casing" and variations thereof, as used herein, refers to large diameter pipe that is assembled by coupling casing sections in an end-to-end configuration which is positioned within a previously-drilled wellbore and which remains within the wellbore after completion of the wellbore to seal walls of the subterranean formation within the wellbore. Furthermore, the term casing includes wellbore casing and casing sections as well as wellbore liner and liner sections. The casing may be made of any suitable material, such as a metal, an alloy, a polymer and a composite.

The term "tubing string" may include, but is not limited to, jointed tubing, coiled tubing, drill pipe, wireline, slick line, or other suitable conveyances and may be made of any suitable material such as a metal, an alloy, a polymer or a composite.

The term "fluid" shall comprehend both liquids and gases and any combination thereof.

The attached Figures depict a bottom hole assembly in accordance with one illustrative embodiment of the subject matter disclosed herein positioned in a wellbore. In general, the illustrative bottom hole assembly depicted herein comprises a by-pass valve assembly, a resettable sealing assembly and a shifting tool assembly. In use, the bottom hole assembly, particularly the by-pass valve assembly, will be coupled (directly or indirectly) to tubing string such that the tubing string is in fluid communication with the bottom hole assembly. In some applications, various devices (not shown) may be positioned between the tubing string and the bottom hole assembly. For example, a check valve assembly (dual flapper valve), a release tool, a burst disk or other well-known downhole components may be positioned above the illustrative by-pass valve assembly. The use and structure of such additional devices are well known to those skilled in the art. Accordingly, further details of such additional devices are not provided so as not to obscure the present disclosure.

Referring generally to FIG. 1, a well system 1 is depicted deployed in a wellbore 2. In the illustrated embodiment, the well system 1 comprises a completion string 6 deployed within the wellbore 2 via, for example, tubing string. In many applications, the completion string 6 is deployed within a cased wellbore having a casing 3, however the completion string 6 can also be deployed in an uncased wellbore (i.e. an open hole application). As illustrated, the completion string 6 comprises at least one well tool 7, with one or more of the well tools 7 being shiftable between two or more configurations. The well tool 7 may have a variety of shapes and sizes as well as profiles for location purposes. Depending on the application, the well tool 7 may comprise, for example, one or more: (a) valves including ball valves, flapper valves, disk valves, flow control valves, circulating or reversing valves, and other valves that are shifted during a given downhole procedure; (b) plugs or (c) sliding ports or sleeves. In the embodiment shown in FIG. 1, the well tools 7 are shown as collars or subs for attachment of adjacent lengths of tubing string. It is, however, contemplated that a similar well tool configuration could be used in other applications, that is, as collars or subs for attachment of adjacent lengths of casing for lining wellbore 2, whether cemented in place or otherwise positioned within wellbore 2.

The well system 1 further comprises a bottom hole assembly 10 according to the present disclosure and a deployment mechanism 8. Depending on the specific application, the deployment mechanism 8 may have a variety of forms. For example, the deployment mechanism 8 may comprise tubing string. Additionally or alternatively, a tractor or stroker 9 can be used to move bottom hole assembly 10. In the illustrated embodiment, the bottom hole assembly 10 can be moved along the interior of wellbore 2 for selective engagement with one or more of the well tools 7. The deployment mechanism 8 is only shown for illustrative purposes, and thus is not included in each Figure depicting an embodiment of the bottom hole assembly 10.

Figure 1A:
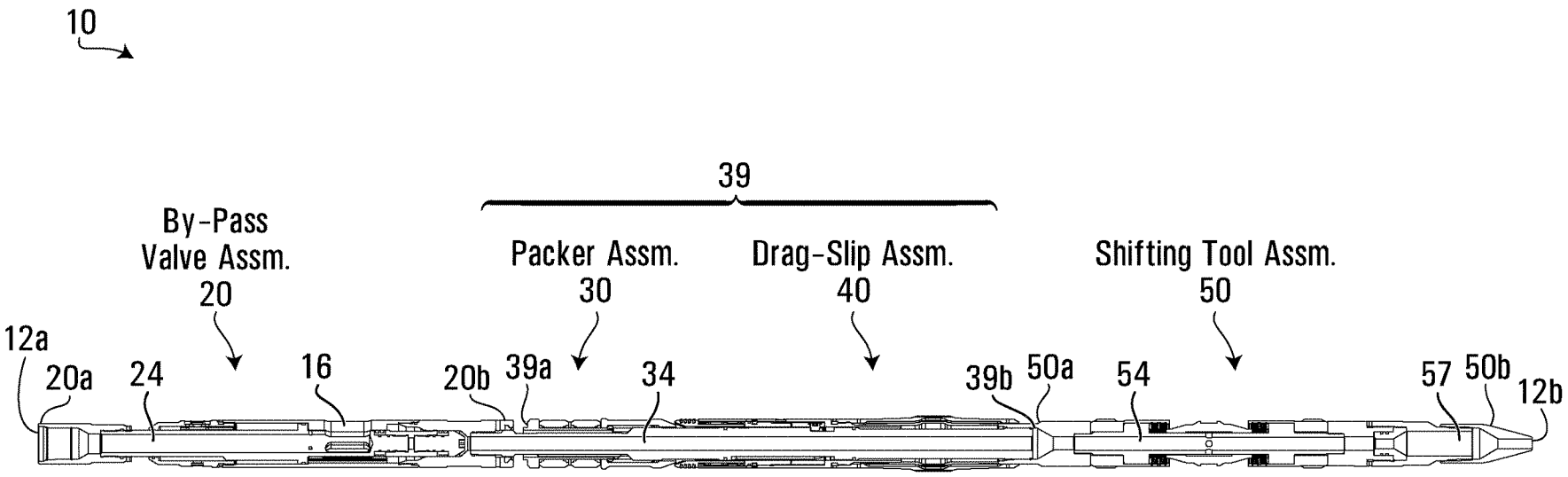
FIG. 1*a* depicts an embodiment of the bottom hole assembly with a by-pass valve assembly, a packer assembly, a drag-slip assembly and a shifting tool assembly.

Referring to FIG. 1*a*, the bottom hole assembly 10 is depicted according to one embodiment of the present disclosure. As described above, the bottom hole assembly 10 is intended to be incorporated into a deployment mechanism 8 (not shown), which will be referred to throughout the remainder of the present disclosure as tubing string, with an upper end 12*a* of the bottom hole assembly 10 being adapted for connection to an upper tubing string and a lower end 12*b* of the bottom hole assembly being adapted for connection to a lower tubing string or in some aspects (as shown) is not adapted for connection to a lower tubing string. The bottom hole assembly 10 will therefore have a fluid flow passage therethrough. The ends of bottom hole assembly 10 can be formed for connection in various ways. For example, they can be threaded or have other forms or structures to permit alternate forms of connection. Fluid flow occurs lengthwise through the upper tubing string, and thus through bottom hole assembly 10, during wellbore operations. As will be described in more detail below, the bottom hole assembly 10 is operable in at least four configurations and generally includes i) a by-pass valve assembly 20 having an uphole end 20*a* and a downhole end 20*b* and a first flow passage 24 extending therebetween and at least one port 16 for fluid communication from the first flow passage 24 to an annular area outside the bottom hole assembly when the by-pass valve assembly 20 is in an open position, ii) a resettable sealing assembly 39 having an uphole end 39*a* and a downhole end 39*b* and a second flow passage 34 extending therebetween in fluid communication with the first flow passage 24 when the by-pass valve assembly is a closed position, and iii) a shifting tool assembly 50 having an uphole end 50*a* and a downhole end 50*b* and a third flow passage 54 extending therebetween in fluid communication with the second flow passage 34 and a restriction nozzle 57 positioned at the downhole end.

It will be appreciated that the bottom hole assembly 10 of the present disclosure generally relates to an apparatus and method for performing multiple operations within a length of tubing, in some aspects in a single trip, the length of tubing having ports, slots, apertures or other pathways through which fluid can be delivered laterally from the tubing string to the wellbore. Accordingly, the term "housing" is generally used to refer to a length of tubing through which fluid flow can occur lengthwise and having a fluid passage for lateral fluid communication between an inlet and an outlet of the housing. It will also be appreciated that the by-pass valve assembly 20, resettable sealing assembly 39 and shifting tool assembly 50 can be connected within the bottom hole assembly 10 in various ways, such as through adaptors or connectors or other means known in the art.

According to one embodiment, the by-pass valve assembly 20 can be positioned at the top of the bottom hole assembly 10 and can be fluid pressure controlled to direct fluid flow to: (i) the exterior of the bottom hole assembly 10 through port 16 in one valve orientation; or (ii) the shifting tool assembly 50 through the resettable sealing assembly 39 in another valve orientation. The by-pass valve assembly 20 is moveable between orientations (i) and (ii) by reaction to a pressure differential. Since the by-pass valve assembly 20 is capable of communicating fluid to the exterior of the bottom hole assembly 10 in one orientation when in an open position and to the shifting tool assembly 50 in another orientation when in a closed position, it is operable in connection with at least two steps during a hydraulic fracture operation: wellbore fracking and downhole shifting of a well tool.

Figure 2:
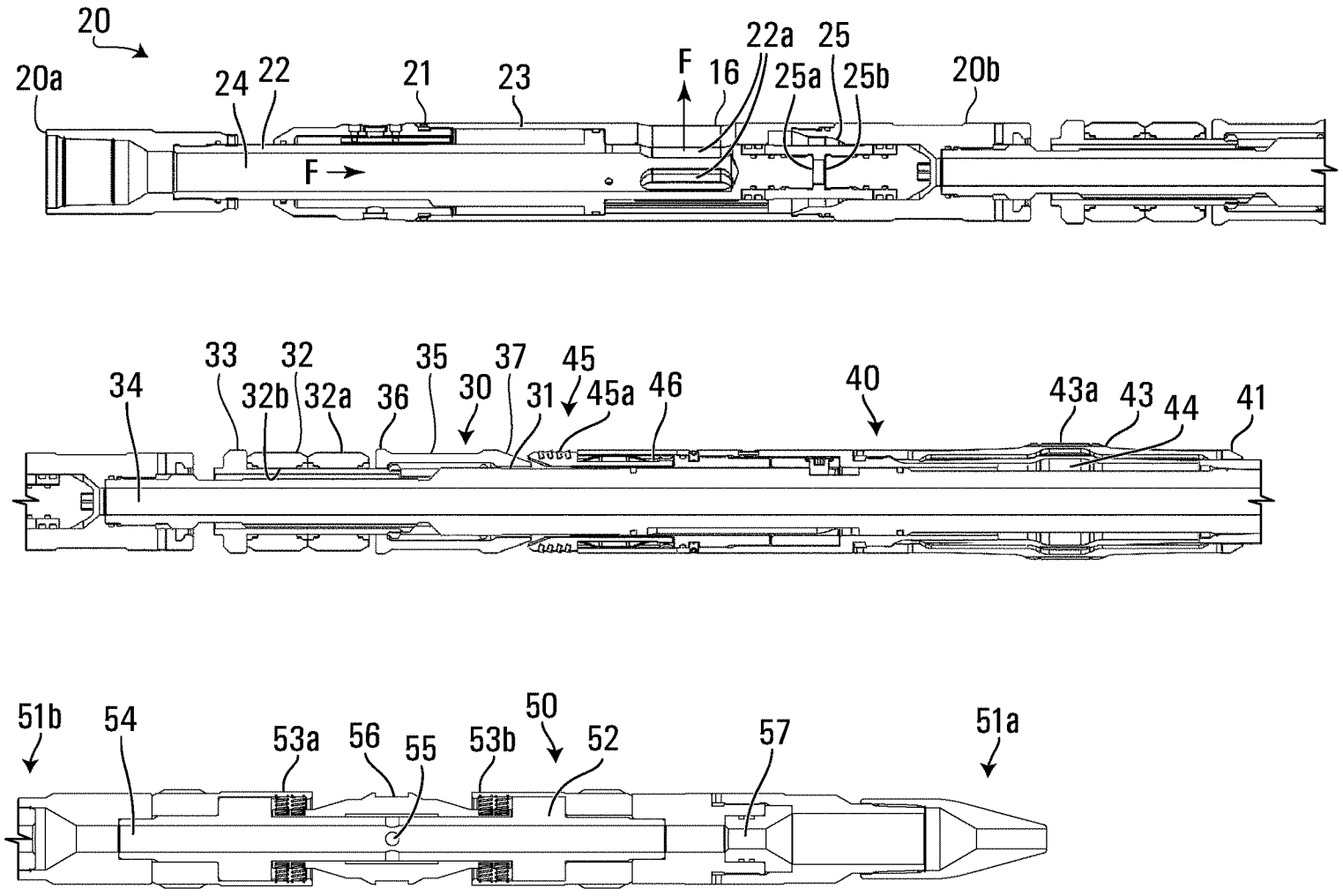
FIG. 2 depicts a run in configuration of the bottom hole assembly of FIG. 1*a;*
Figure 3:
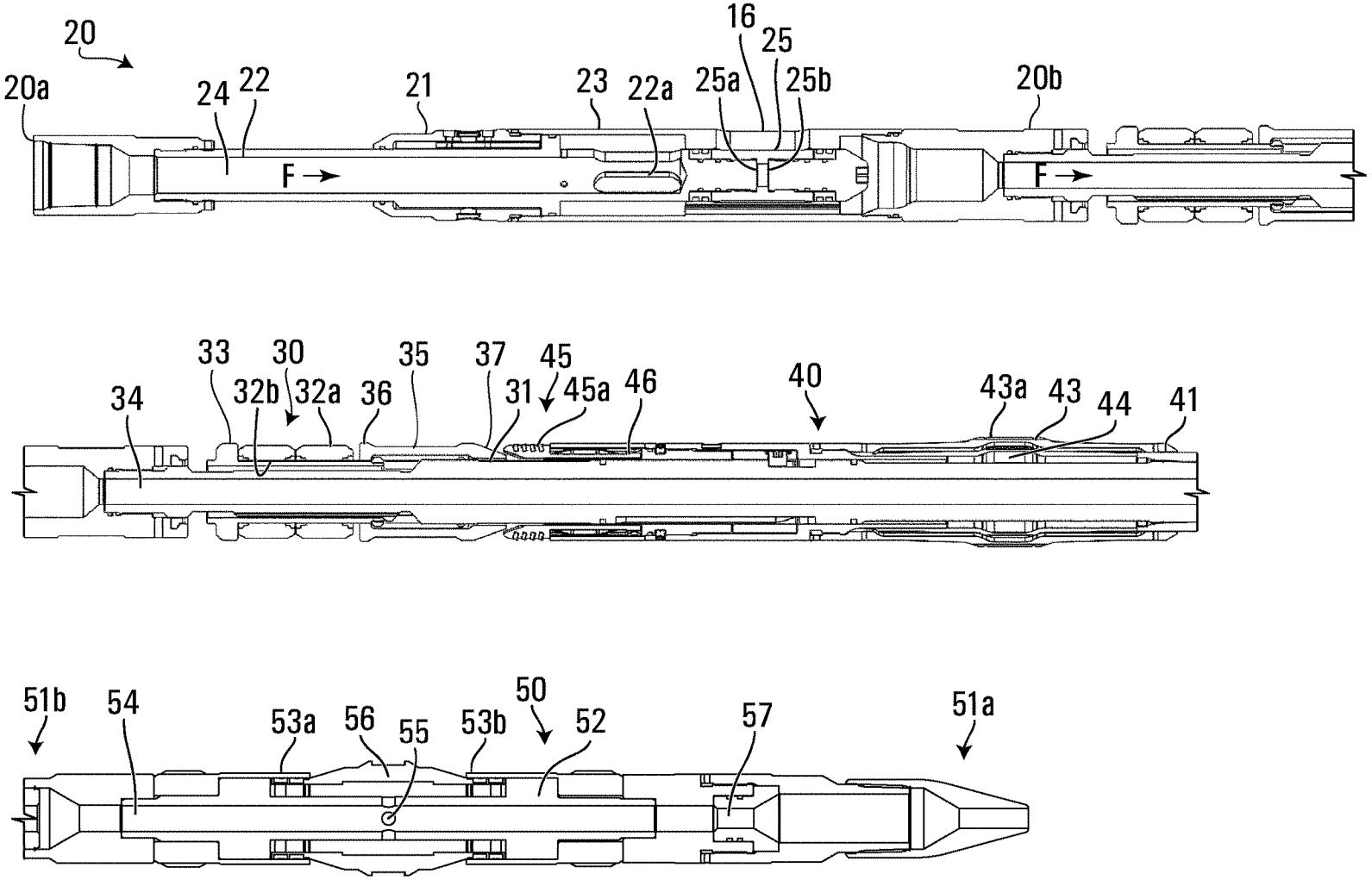
FIG. 3 depicts a shifting configuration of the bottom hole assembly of FIG. 1*a;*
Figure 3A:
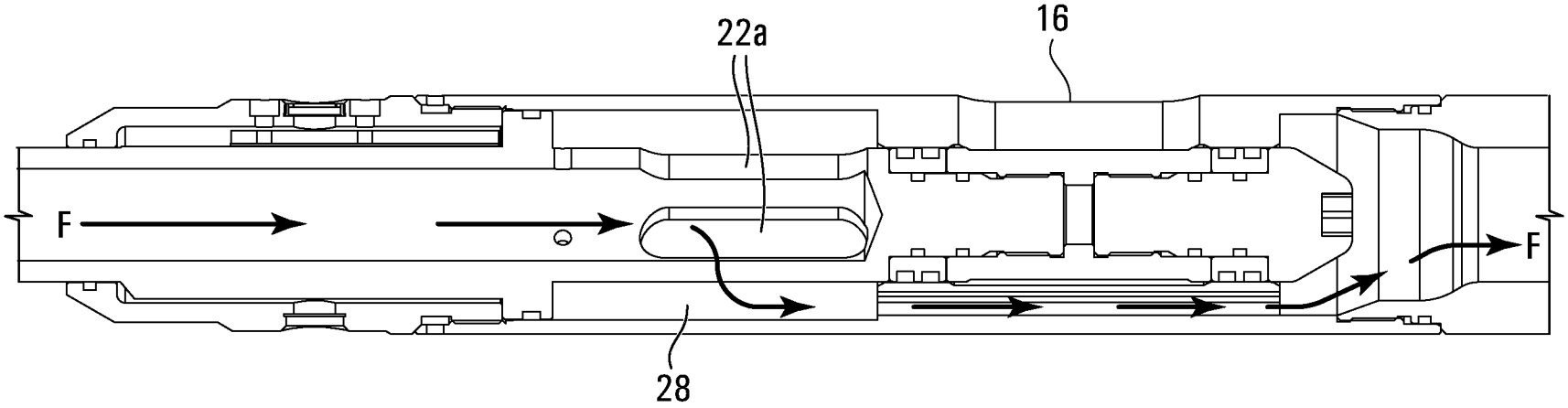
FIGS. 3*a* and 3*b* depict the flow pattern when the bottom hole assembly is in the shifting configuration.
Figure 3B:
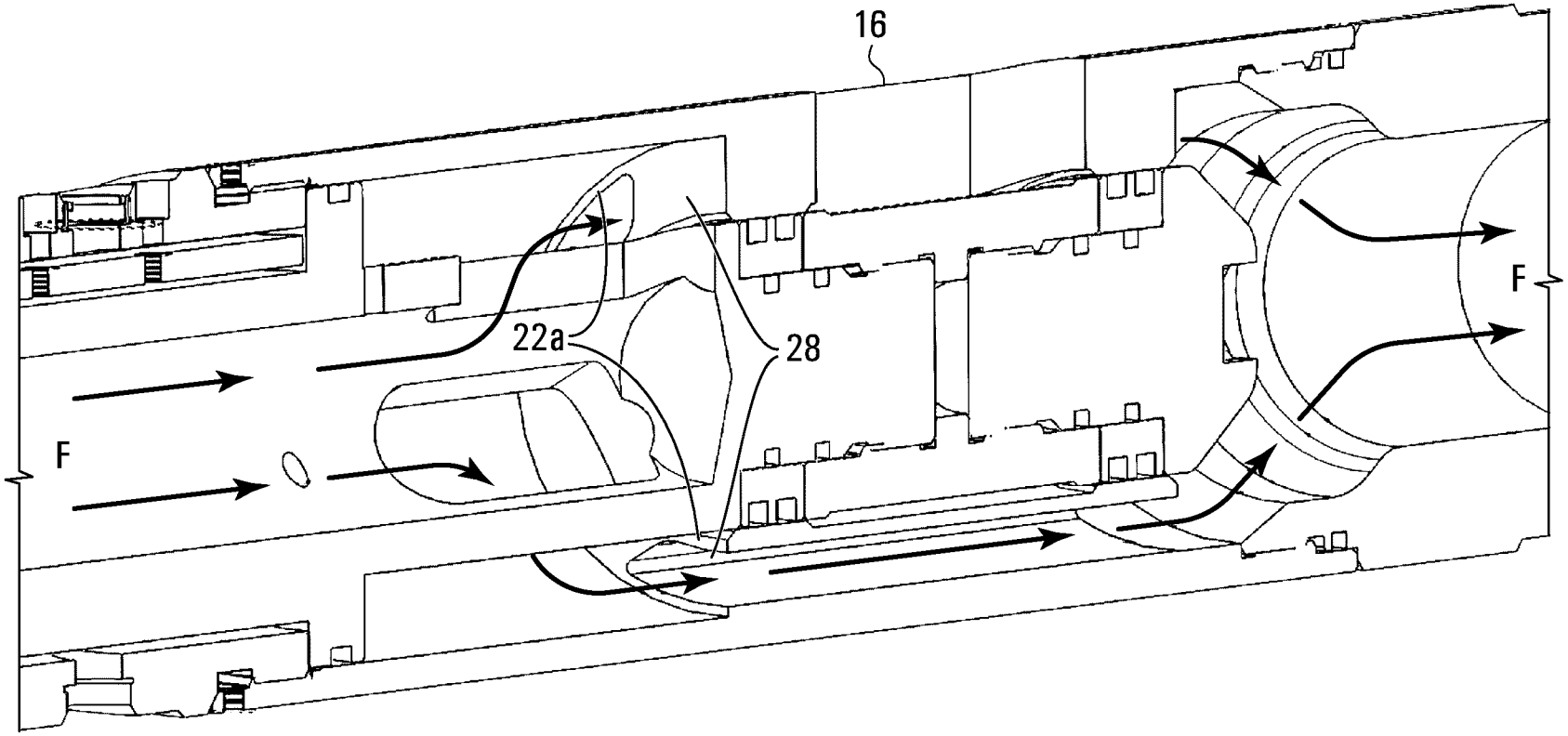
Figure 4:
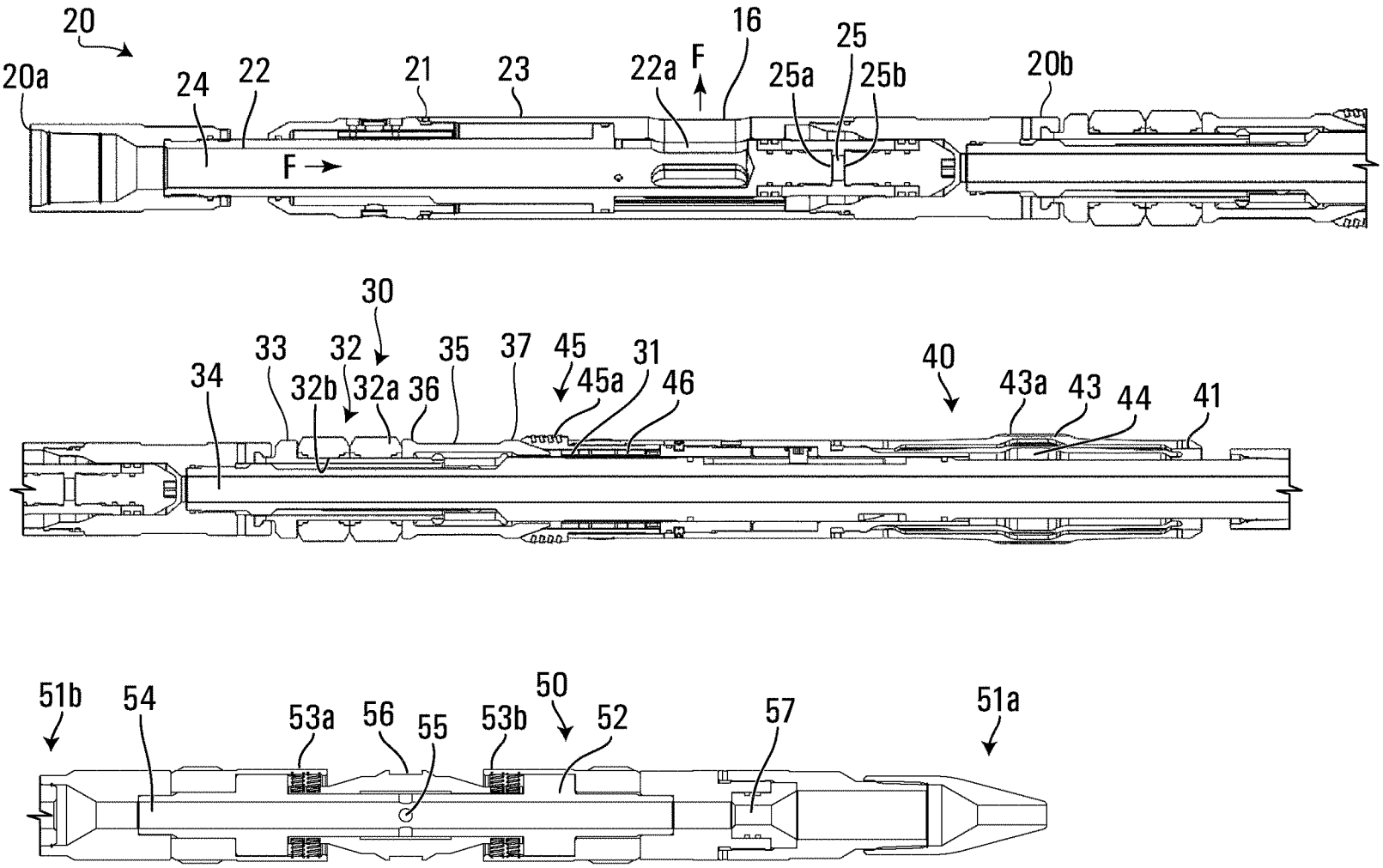
FIG. 4 depicts a treatment configuration of the bottom hole assembly of FIG. 1*a;*
Figure 4A:
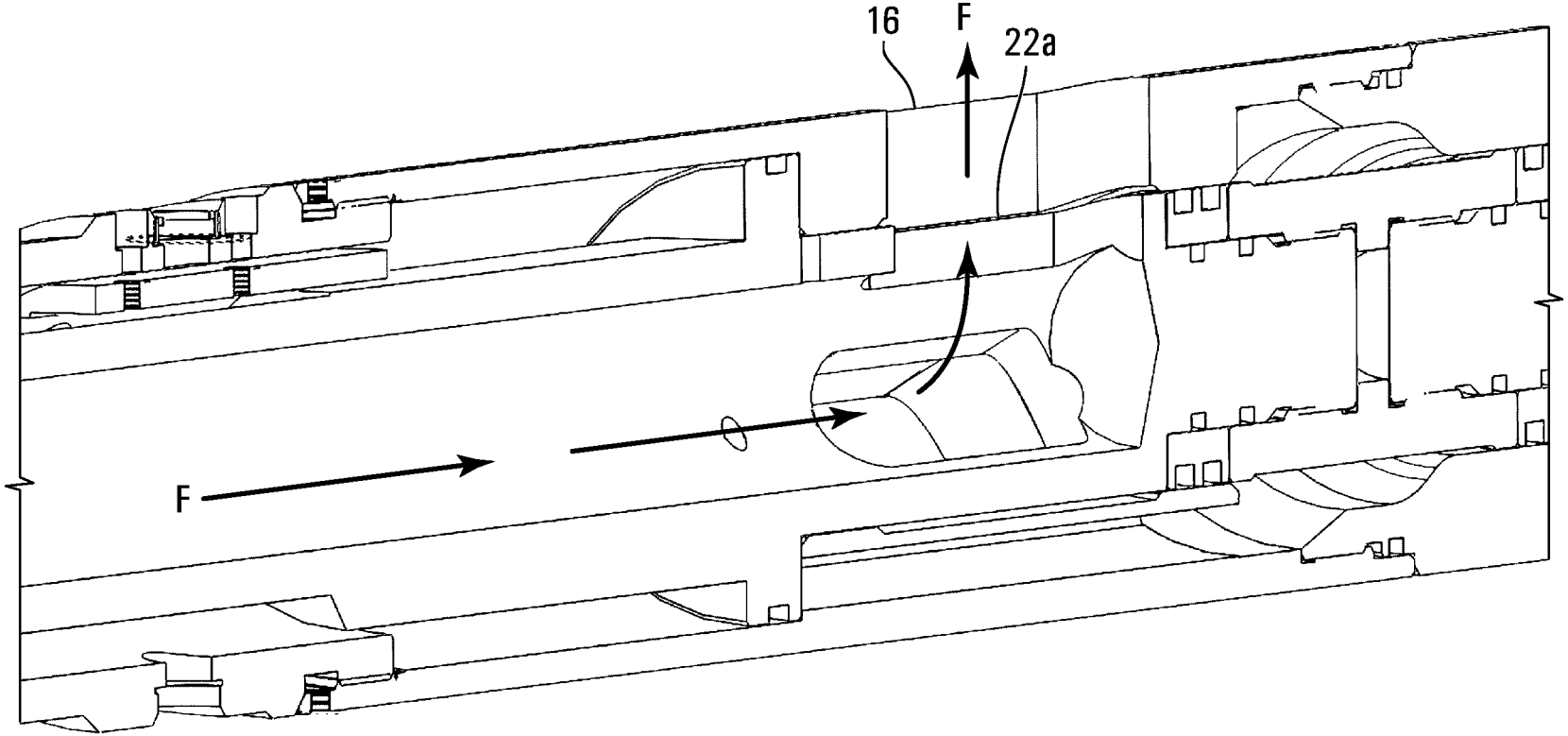
FIG. 4*a* depicts the flow pattern when the bottom hole assembly is in the treatment configuration.

Referring to FIGS. 2, 3, 3*a*, 3*b* and 4*a*, in one embodiment, the by-pass valve assembly 20 includes a valve 21 positioned therein with a housing 22 configured to slide axially relative to an outer sleeve 23 in response to a pressure differential across the valve 21. Thus, the valve 21 includes a longitudinally sliding housing 22 with a longitudinal central axial bore 24 for the passage of fluids conveyed by the upper tubing string. The outer sleeve 23 has one or more ports 16 in its sidewall. The housing 22 has one or more corresponding openings 22*a*. When the one or more ports 16 and the one or more openings 22*a* are aligned (as illustrated in FIGS. 2 and 4*a*), valve 21 is in an "open" position and fluid pumped through central axial bore 24 may exit the bottom hole assembly 10 through opening 22*a* and port 16 in a radial direction; and, fluid flow towards and through the resettable sealing assembly 39 and shifting tool assembly 50 is blocked. When port 16 and opening 22*a* are not aligned (as illustrated in FIGS. 3, 3*a* and 3*b*), valve 21 is in a "closed" position and fluid pumped down central axial bore 24 is directed through openings 22*a* and into annular channel 28 which directs fluid flow past port 16 towards and through the resettable sealing assembly 39 and the shifting tool assembly 50 located downhole from the by-pass valve assembly 20. In this embodiment, each of the ports 16 and openings 22*a* are shown as oval, however each can be any other suitable shape, such as a slot or circular, polygonal or kidney-shaped.

According to one embodiment, the valving between the flow paths is provided by a piston 25 slidably positioned in central axial bore 24. The piston 25 may have two opposed piston faces: an upper piston face 25*a* open to a first pressure above the piston 25; and, a lower piston face 25*b* open to a second pressure below the piston 25. As such, the piston 25 may move based on different effective forces acting on the piston faces. For example, when the first pressure above the piston 25 is equal to or greater than the second pressure below piston 25, the effective force acting on the upper piston face 25*a* will be equal to or greater than the effective force acting on the lower piston face 25*b* and will drive the piston 25 down resulting in housing 22 moving down and the valve 21 being in the open position. The piston 25 will not move up to drive housing 22 up and close the valve 21 until the second pressure below the piston 25 is sufficient to overcome the first pressure-induced force acting on the upper piston face 25*a*. As will be appreciated, the first pressure and the second pressure can be adjusted through the tubing string and bottom hole assembly 10 by pressure adjustment means including, but not limited to, pumping fluids from the surface, pressure relief and flow restriction devices.

Referring to FIG. 1*a*, the bottom hole assembly 10 further includes the resettable sealing assembly 39 positioned below or downhole of the by-pass valve assembly 20 and above or uphole of the shifting tool assembly 50. The resettable sealing assembly 39 serves to maintain the position of the bottom hole assembly 10 downhole and ensures the portion of the wellbore above the resettable sealing assembly 39 is hydraulically isolated from the portion of the wellbore below the resettable sealing assembly 39. Various tools for downhole use as the resettable sealing assembly 39 can include, but are not limited to, bridge plugs, friction cups, inflatable packers and mechanically actuated compressible packers. According to one embodiment, the resettable sealing assembly 39 comprises a packer assembly 30 and a drag-slip assembly 40.

Referring to FIG. 2, the packer assembly 30 can include a housing 31 with a longitudinal central axial bore 34 extending between upper and lower and ends of the housing and operable for the passage of fluids conveyed by the upper tubing string and through the by-pass valve assembly 20. The drag-slip assembly 40 is mounted over the packer assembly 30 and is configured to slide axially relative to the packer assembly 30. The packer assembly 30 and the drag-slip assembly 40 are configurable between an unset position (FIGS. 2 and 5) and a set position (FIG. 4).

The packer assembly 30 further includes one or more packing elements 32 annularly formed and encircling housing 31. The packing element 32 has an outer facing surface 32*a* and an inner facing surface 32*b* operable to create a seal in the wellbore by compression during the set position. For example, in the unset position, (FIG. 2) the packer assembly 30 is in a neutral, uncompressed position with the packing element 32 retracted, for example, to an outer diameter less than the inner diameter of the completion string wall or casing wall in which the bottom hole assembly 10 is positioned. However, in the set position (FIG. 4) packer assembly 30 is in a compressed condition with packing element 32 extruded radially outwardly. For example, during the set position, packing element 32 has an outer diameter pressed against the inner wall of the completion string or casing and therefore equal to the inner diameter of the completion wall or casing wall. Thus, outer facing surface 32*a* is engaged with the inner wall of the completion string or casing and inner facing surface 32*b* is engaged with the outer surface of housing 31. Packer assembly 30 may be returned to the unset position (FIG. 5) by releasing the compressive force on the packer assembly 30, after which the packing element 32 will return to the retracted position.

The packing element 32 can be formed of an elastomeric material, and upon application of compressive forces against its sides, can be squeezed radially outwardly. "Elastomer" as used herein is a generic term for substances emulating natural rubber in that they stretch under tension, have a high tensile strength, retract rapidly, and substantially recover their original dimensions (or even smaller in some embodiments). The term includes natural and man-made elastomers, and the elastomer may be a thermoplastic elastomer or a non-thermoplastic elastomer. The term includes blends (physical mixtures) of elastomers, as well as copolymers, terpolymers, and multi-polymers. Examples include ethylene-propylene-diene polymer, various nitrile rubbers which are copolymers of butadiene and acrylonitrile such as Buna-N, polyvinylchloride-nitrile butadiene blends, chlorinated polyethylene, chlorinated sulfonate polyethylene, aliphatic polyesters with chlorinated side chains such as epichlorohydrin homopolymer, epichlorohydrin copolymer, and epichlorohydrin terpolymer, polyacrylate rubbers such as ethylene-acrylate copolymer, ethylene-acrylate terpolymers, elastomers of ethylene and propylene, sometimes with a third monomer, such as ethylene-propylene copolymer, ethylene vinyl acetate copolymers, fluorocarbon polymers, copolymers of poly(vinylidene fluoride) and hexafluoropropylene, terpolymers of poly(vinylidene fluoride), hexafluoropropylene, and tetrafluoroethylene, terpolymers of poly (vinylidene fluoride), polyvinyl methyl ether and tetrafluoroethylene, terpolymers of poly(vinylidene fluoride), hexafluoropropylene, and tetrafluoroethylene, terpolymers of poly(vinylidene fluoride), tetrafluoroethylene, and propylene, perfluoroelastomers such as tetrafluoroethylene perfluoroelastomers, highly fluorinated elastomers, butadiene rubber, polychloroprene rubber, polyisoprene rubber, polynorbornenes, polysulfide rubbers, polyurethanes, silicone rubbers, vinyl silicone rubbers, fluoromethyl silicone rubber, fluorovinyl silicone rubbers, phenylmethyl silicone rubbers, styrene-butadiene rubbers, copolymers of isobutylene and isoprene known as butyl rubbers, brominated copolymers of isobutylene and isoprene and chlorinated copolymers of isobutylene and isoprene.

The packer assembly 30 further includes compression collars 33 and 35, these collars also being annularly formed to encircle housing 31. Compression collar 35 can include an upper shoulder 36 and a guide surface 37. During the set position, when the packer assembly 30 and packing element 32 are compressed and squeezed out between the compression collar 33 and the upper shoulder 36 of the compression collar 35 (FIG. 4), the outer facing surface 32*a* of the packing element 32 is driven into contact with the inner wall of the completion string or casing in which the bottom hole assembly 10 is positioned. At the same time, the inner facing face 32*b* of the packing element 32 becomes pressed against the housing 31. As a result, the packing element 32 forms a seal in the annular area between the housing 31 and the inner wall of the completion string to prevent fluids from passing through the annular area. The compression collars 33 and 35 and the upper shoulder 36 can be formed of rigid materials, such as a metal or an alloy, to transfer compressive forces to the packing element 32. The compression collars 33 and 35 and the upper shoulder 36 may also have a radial thickness selected to resist lateral extrusion of the packing element 32, and instead direct the packing element 32 radially outward as it's compressed.

The force to achieve compression of the packing element 32 can be a result of pushing one compression collar toward the other while the other is held stationary. The other compression collar may also have a pushing force applied thereto, but as the bottom hole assembly 10 is intended for downhole use, routinely force is applied from the surface by manipulation of the upper tubing string, into which the bottom hole assembly 10 is connected, while a part of the tool is held steady. For example, if the bottom hole assembly 10 is installed with end 12*a* connected to the upper tubing string with the upper tubing string extending uphole toward the surface, force can be applied by lowering (pushing) or pulling on the upper tubing string. In this embodiment, the packer assembly 30 can be compressed by lowering or pushing down on the upper tubing string attached at end 12*a* while the drag-slip assembly 40 is held stationary. The drag-slip assembly 40 is thus operable to create a fixed stop or anchor against which the packer assembly 30 and packing element 32 can be compressed and expanded out radially. The packer assembly 30 and drag-slip assembly 40 may therefore be operable to set and unset the packer assembly 30 using tubing reciprocation: put weight on the upper tubing string when in tension (to set) and pull up on the tubing string (to unset).

To be operable as a fixed stop or anchor, the drag-slip assembly 40 can include a locking mechanism for locking its position relative to the inner wall of the completion string or casing in which the bottom hole assembly 10 is positioned. For example, the drag-slip assembly can include a body 41 and a drag mechanism carried by the body 41 which is formed to engage the inner wall of the completion string or casing. The drag mechanism may include for example, one or more drag blocks 43 that are biased radially outwardly from body 41, for example, by springs 44. The drag block 43 can include an outer engaging face 43*a* formed to frictionally engage, and provide resistance to movement along the surface of the completion string's or casing's inner wall. While the drag block 43 can be forced to move across the inner wall of the completion string, the drag block 43 frictionally engages against the surface of the completion string's or casing's inner wall such that a resistance force is generated by movement of the drag block 43. This resistance is transferred to body 41 such that the movement of the drag-slip assembly 40 relative to the inner wall of the completion string or casing is also resisted. Thus, if the bottom hole assembly 10 is moved through the completion string or casing defined by such an inner wall, the drag-slip assembly 40 can only be moved along the inner wall by applying a force to the drag-slip assembly 40, for example by putting weight on (i.e. pushing) or pulling up on the tubing string carrying the bottom hole assembly 10.

As noted above, the drag-slip assembly 40 can be locked into a position relative to the packer assembly 30 while the tubing string is lowered or pushed down through these members until packer assembly 30, and in particular packing element 32, is compressed between the compression collar 33 and the shoulder 36 of compression collar 35. While the drag block 43 may be selected to lock drag-slip assembly 40 in a position for this purpose, a stronger locking mechanism may be further required to lock the position of the drag-slip assembly 40. Thus, in this embodiment, the drag-slip assembly 40 further includes one or more anchor slips 45 carried on body 41. The anchor slip 45 is normally retracted but can be driven radially out into engagement with the inner wall of the completion string or casing in which the bottom hole assembly 10 is positioned to lock the drag-slip assembly 40 in a selected position when appropriate to do so. The anchor slip 45 includes a keeper 46 that holds the anchor slip 45 on body 41. The anchor slip 45 can also include teeth 45*a* on the outer face of the anchor slip 45, the teeth 45*a* being selected to bite into the material of the inner wall of the completion string or casing. The teeth 45*a* may be selected with consideration as to the hardness and material of the inner wall of the completion string or casing, for example, a metal or an alloy surface, or an exposed wellbore wall.

The drag-slip assembly 40 further includes a mechanism for driving the one or more anchor slips 45 radially out from the retracted positon. The anchor slip 45 may be driven out by employing various mechanisms known to those skilled in the art. In this embodiment, the driving mechanism operates in response to compressive force applied to the bottom hole assembly 10. For example, in the illustrated embodiment, an expansion force is driven by the guide surface 37 having an angled face, illustrated as frustoconically-shaped, that functions in cooperation with a compressive force applied along axis x of the bottom hole assembly 10 and packer assembly 30. In this aspect, the compressive force is applied by pushing down on the upper tubing string which transfers the compressive force through by-pass valve assembly 20 and the packer assembly 30 and to the guide surface 37, while the drag-slip assembly 40 is maintained in a position fixed against axial movement. Since the drag-slip assembly 40 cannot move, any compressive force applied to the bottom hole assembly 10 acts to move the anchor slip 45 out due to the shape of the face of the guide surface 37.

Thus, in this embodiment, it is the guide surface 37 that bears against the anchor slip 45. The anchor slip 45 is in a position to be lifted by the guide surface 37 when the end of the guide surface 37 is urged beneath the anchor slip 45. For example, when a compressive force is exerted by the upper tubing string, guide surface 37 passes beneath the anchor slip 45 and acts to move the anchor slip 45 radially outwardly into contact with the inner wall of the completion string or casing in which the bottom hole assembly 10 is positioned. As will be appreciated, the outer diameter of the guide surface 37 and the thickness of the anchor slip 45, where they overlap, must be selected with consideration as to the distance between the bottom hole assembly 10 and inner wall of the completion string or casing.

To more efficiently and stably translate compressive axial motion into radially directed force to drive the anchor slip 45 radially outward, the backside surface of the anchor slip 45 may also be shaped to have an angled face similar to that of guide surface 37.

Accordingly, in this embodiment, the one or more drag blocks 43 provide an initial resistance to a compressive force that permits the one or more anchor slips 45 to become initially engaged with the guide surfaces 37 and the anchor slips 45 provide the locking effect necessary for setting the packer assembly 30 when additional compressive force is applied to the bottom hole assembly 10. In particular, the drag block 43, through engagement with the inner wall of the completion string or casing in which the bottom hole assembly is positioned, provide an initial locking effect to hold the drag-slip assembly 40 stationary such that further applied compressive urges the anchor slip 45 over the guide surface 37 and radially outward to bite into the inner wall of the completion string or casing and hold the drag-slip assembly 40 more firmly in a locked position. Further compressive force can then be applied to compress and expand the packer assembly 30 and packing element 32.

Referring to FIG. 2, the bottom hole assembly 10 further includes a shifting tool assembly 50. The shifting tool assembly 50 can be positioned below or downhole of the resettable sealing assembly 39, in this embodiment the packer assembly 30 and the drag-slip assembly 40, and is adapted to manipulate a well tool, for example a ported tubular, and, for example, shift it from a first position (for e.g. a closed position) to a second positon (for e.g. an open position) or vice versa. Various examples of shifting tool assemblies useful in the present disclosure include, but are not limited to, the Otis® B Positioning Shifting Tool and Rapidshift® Hydraulic Shifting Tool (available from Haliburton), the B Shifting Tool (available from Brace Tool), the F/A Double Ended Selective Shifting Tool (available from National Oilwell Varco) and the SureShift™ Shifting Tool (available from Gryphon Oilfield Solutions).

The shifting tool assembly 50 benefits from being pressure-activated. As discussed in more detail below, the shifting tool assembly 50 includes one or more shift keys 56 operable to extend radially out and engage the well tool in response to differential pressures within the bottom hole assembly 10. For example, when there is no fluid flow in the shifting tool assembly 50, springs 53*a* and 53*b* hold the shift key 56 in a retracted position. When fluid flow passes through shifting tool assembly 50, the restriction nozzle 57 of the shifting tool assembly 50 is operable to create a differential pressure at the lower end 50*b* of the shifting tool assembly. This differential pressure can provide an upward force which can be used to overcome the force exerted by the springs 53*a* and 53*b* thereby expanding the shift key 56 radially outward to engage or grip the well tool.

Referring to FIGS. 2 and 3, the shifting tool assembly 50 can include a housing 52 having one or more openings 55 (which can be circular, oval, a slot, polygonal or kidney-shaped) and a longitudinal central axial bore 54 extending between first and second ends 51*a* and 51*b*, respectively, and operable for the passage of a fluid conveyed by the upper tubing string and through the by-pass valve assembly 20 and resettable sealing assembly 30. The shifting tool assembly 50 also includes the one or more shift keys 56 radially extendable from the shifting tool assembly so as to be selectably engageable with the surface of the well tool (not shown) that surrounds housing 51. The shifting tool assembly 50 also includes the upper spring 53*a* and a lower spring 53*b* positioned on opposite ends of the shift key 56. Springs 53*a* and 53*b* are biased to hold the shift key 56 in a retracted position. When fluid is pumped down from the surface through the upper tubing string and through the bottom hole assembly 10, a differential pressure can be created due to the presence of restriction nozzle 57. Increasing the flow rate can force fluid flow through the one or more openings 55 causing pressure to build on a bottom face of shift key 56. When this pressure exceeds the force exerted by the springs 53*a* and 53*b* to hold the shift key 56 in a retracted position, the shift key 56 will compress springs 53*a* and 53*b* and expand out in a radial direction and engage the surface of the well tool. The upper tubing string can then be pushed down or pulled up to manipulate the well tool to shift the well tool from a first position (for e.g. closed) to a second position (for e.g. open) or vice versa as required.

In use, the bottom hole assembly 10 should be properly located within the completion string or casing at the desired zone to shift and fracture. In some embodiments, locating the bottom hole assembly 10 may be accomplished using one or more mechanical collar locators (not shown). The use of such collars, and other similar means, for positioning the bottom hole assembly 10 at the desired location within the completion string or casing are well known to those skilled in the art, and thus they will not be described in any further detail.

As noted above, the bottom hole assembly 10 is operable in at least four configurations. The bottom hole assembly 10 may be moved between the configurations hydraulically or application of tension or compression to the bottom hole assembly 10 via the tubing string and an auto-J mechanism. Auto-J mechanisms are well known to those skilled in the art and generally work by advancing a pin along various positions of a continuous j-slot track with the positions corresponding to a configuration of the bottom hole assembly.

According to one embodiment the bottom hole assembly 10 may be run into a wellbore in a first configuration. In the first configuration, the by-pass valve assembly 20 is in a down position and valve 21 is an open position resulting in the one or more ports 16 and the one or more openings 22*a* being aligned. The packer assembly 30 is in a relaxed unset position and the one or more packing elements 32 are in a retracted position. The one or more anchor slips 45 and the one or more shift keys 56 are also in a retracted position.

Figure 7:
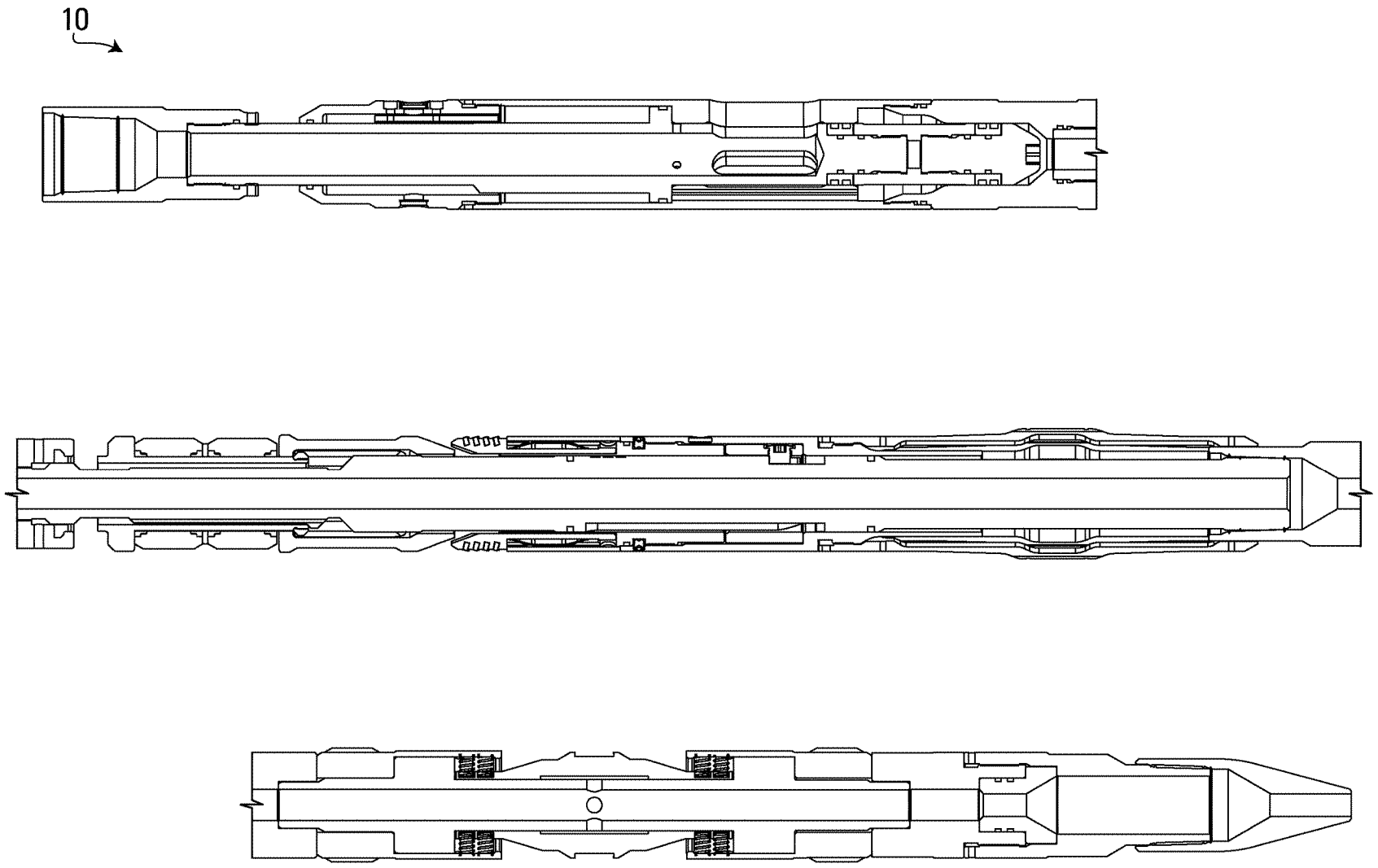
FIG. 7 depicts a run-in configuration of the bottom hole assembly of FIG. 1*a;*

FIGS. 2 and 7 illustrate the bottom hole assembly 10 in the first (or run in) configuration. According to some embodiments, there is no fluid flow from the surface down through the upper tubing string and therefore no fluid flow through the bottom hole assembly 10. According to other embodiments, the first configuration can also be used to circulate a fluid, such as a circulating fluid, down through the bottom hole assembly 10, out the aligned port(s) 16 and opening(s) 22*a* and up the annular area between the bottom hole assembly 10 and completion string or casing to the surface or vice versa. The circulating fluid can include, but is not limited to an aqueous liquid, such as water, solutions containing water, salt solutions, or water containing an alcohol or other organic solvent. "Water" as used herein includes, but is not limited to, freshwater, pond water, sea water, salt water or brine source, brackish water and recycled or re-use water, for example, water recycled from previous or concurrent oil- and gas-field operations. The pin in the j-slot track is in a position such that anchor slips 45 will not move along the packer assembly 30 and engage the guide surface 37 and therefore the packing element(s) 32 is in a retracted position. The bottom hole assembly 10 remains in the first configuration while it is being positioned at a particular location, such as adjacent to a well tool, within the completion string or casing by pulling up or pushing down on the tubing string.

Figure 8:
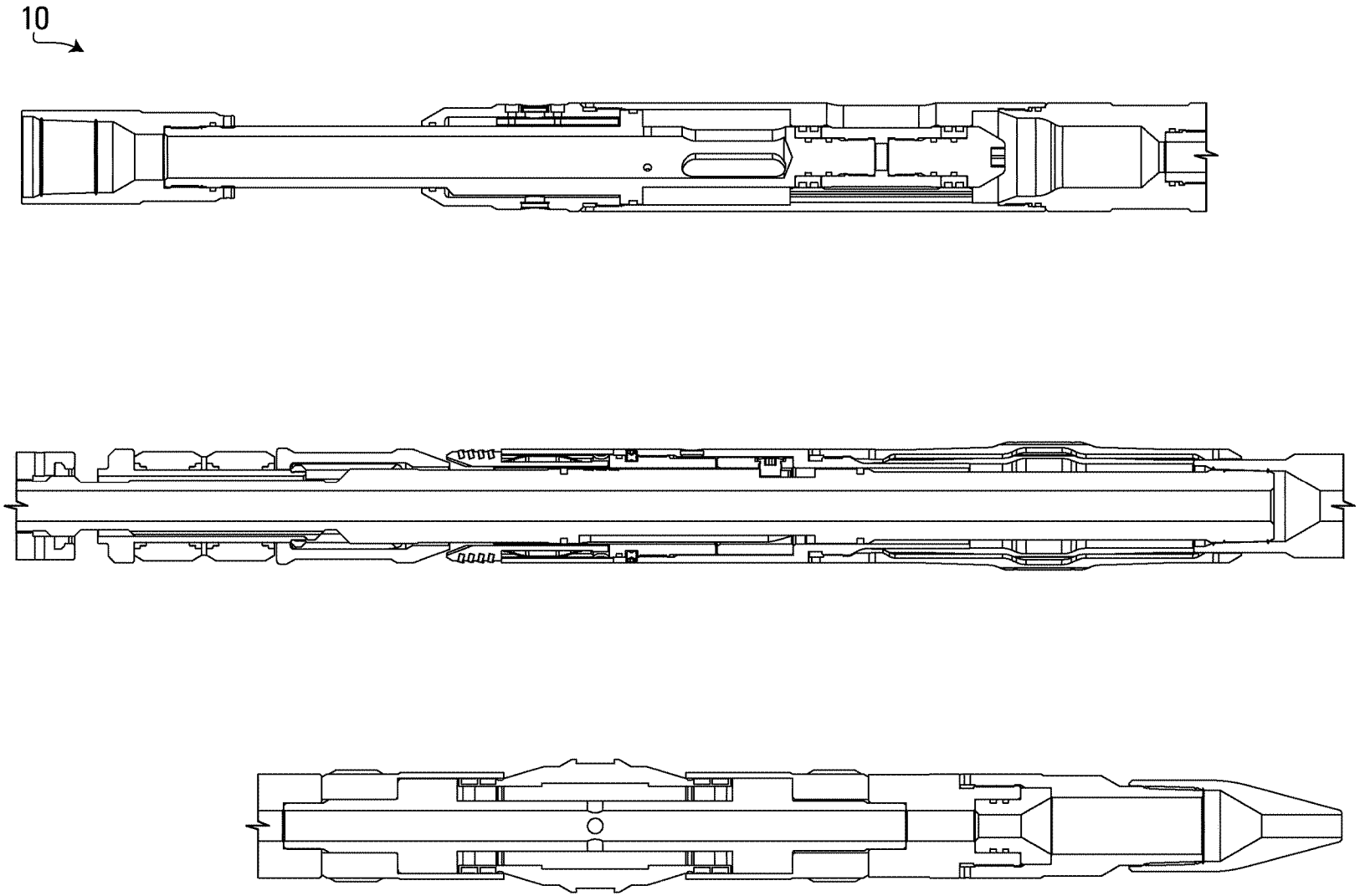
FIG. 8 depicts a shifting configuration of the bottom hole assembly of FIG. 1*a;*

FIGS. 3 and 8 illustrate the bottom hole assembly 10 in the second (or shifting) configuration, after the bottom hole assembly 10 has been positioned within the completion string at a particular location. To initiate activation of the shifting tool assembly, the upper tubing is pulled up to force the housing 22 of valve 21 to slide up and port(s) 16 and opening(s) 22*a* to become misaligned (i.e. valve 21 is in a closed position). A first fluid can then be pumped down from the surface through the tubing string and through the by-pass valve assembly 20, packer assembly 30 and shifting tool assembly 50. The first fluid can include, but is not limited to, an aqueous liquid. As the flow of the first fluid is increased, the differential pressure created by the first fluid flowing through the restriction nozzle 57 forces the first fluid to flow through the one or more openings 55 which causes pressure to build on the lower face of shift key(s) 56, such pressure subsequently becoming large enough to overcome the force applied by springs 53*a* and 53*b* and allowing the shift key(s) 56 to expand outward and engage the surface of the well tool, such as a ported tubular. The differential pressure created by the first fluid flowing through the restriction nozzle 57 can also act on the piston 25 of the by-pass valve assembly 20 to maintain the housing 22 in the up position and the valve 21 in a closed positon, and thus maintaining flow of the first fluid through the bottom hole assembly 10. The pin in the j-slot track is in a position such that the anchor slip(s) 45 will not move along the packer assembly 30 and engage the guide surface(s) 37 and therefore the packing element(s) 32 will be in a retracted position. The bottom hole assembly 10 can thus be pulled up or pushed down while the shift key(s) 56 are expanded to shift a port of the ported tubular. Once shifting is completed, the flow of the first fluid can be reduced or stopped to reduce the differential pressure created by flow through the restriction nozzle 57 and thus collapsing the shift key(s) 56.

Thus, in summary, in the second configuration the by-pass valve assembly 20 is in an up position and valve 21 is in a closed position. The packer assembly 30 is in the unset position and the packing element(s) 31 and the anchor slip(s) 45 are in a retracted position. The shift key(s) 56 is expanded out from the bottom hole assembly 10 in a radial direction. While in the second configuration, the bottom hole assembly 10, acting through the pulling up or pushing down on the tubing string, may be moved up or down in order to manipulate a well tool, such as shifting a port of a ported tubular along the completion string or casing from a first position (for e.g. closed position) to a second position (for e.g. open position).

Figure 9:
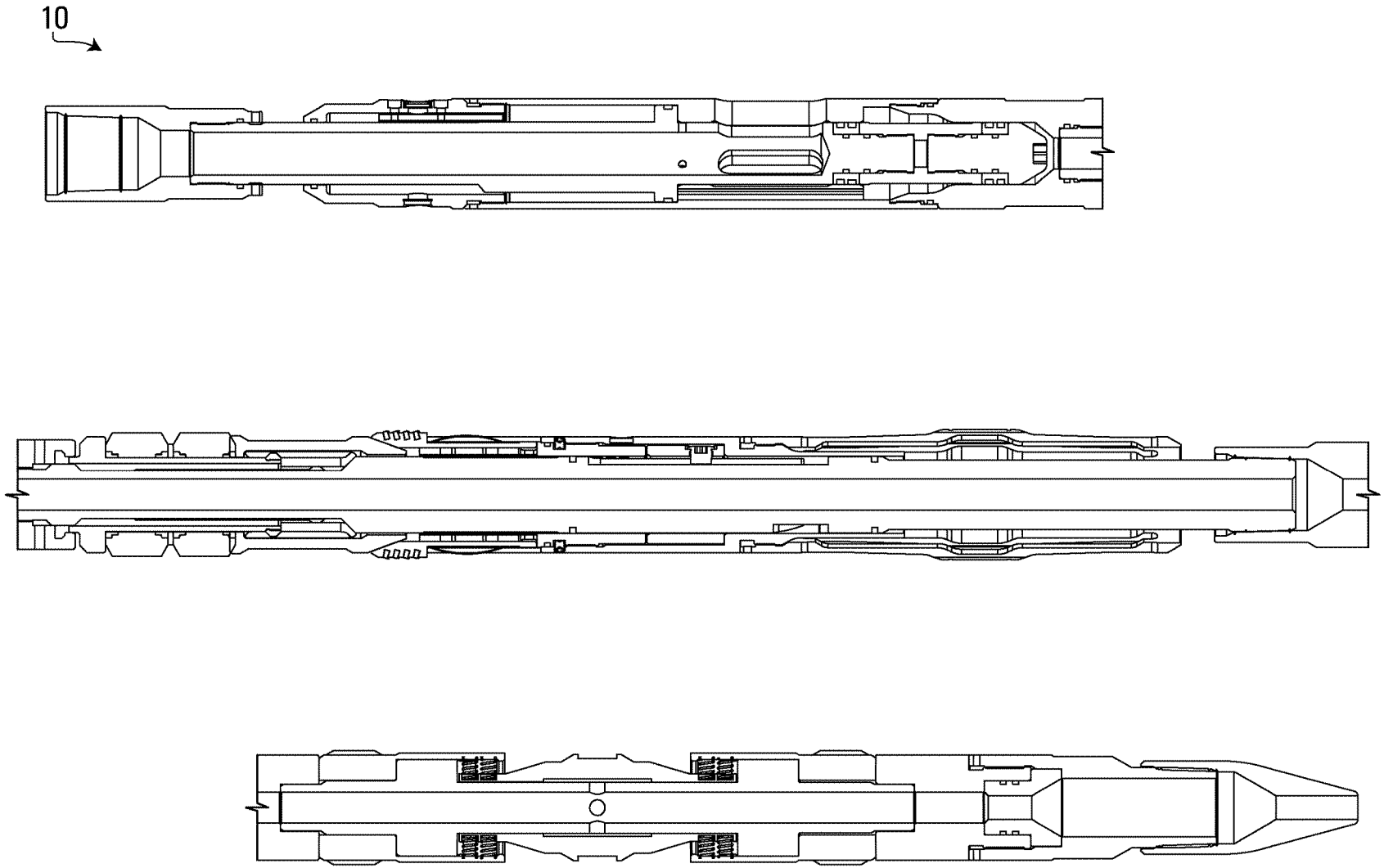
FIG. 9 depicts a treatment configuration of the bottom hole assembly of FIG. 1*a*.

FIGS. 4 and 9 illustrate the bottom hole assembly 10 in the third (or treatment) configuration. In the third configuration, the by-pass valve assembly 20 (and housing 22) has moved down and the valve 21 is again in an open position since the differential pressure created by fluid flow through the restriction nozzle 57 is no longer acting on the piston 25 to maintain the by-pass valve assembly 20 in the up position. The auto-J mechanism is cycled (by manipulating the tubing string) until the pin in the j-slot track is in a position such that the drag-slip assembly 40 and the anchor slip(s) 45 can move along the packer assembly 30. The upper tubing string is then pushed down to drive the drag-slip assembly 40 into the packer assembly 30 causing the packer assembly 30 to compress and the packing element(s) 32 to expand radially outward to seal off the annular area between the outer surface of the bottom hole assembly 10 and inner wall of the ported tubular. The packing element(s) 32 also will compress against the outer surface of the housing 31 of the packer assembly 30. While in the third configuration a portion of the wellbore above the packing element(s) 32 may be treated through the shifted port (or ports) in the completion string or casing by pumping a second fluid down from the surface through the tubing string. The treatment of the wellbore can be one or more of various treatments as would be appreciated by one of ordinary skill in the art. For example, the treatment may be, but is not limited to, hydraulic fracturing, stimulation, tracer injection, cleaning, acidizing, steam injection, water flooding, or cementing. Accordingly the second fluid (or treatment fluid) can include, but is not limited to, any fluid that may be used in a subterranean application in conjunction with a desired function and/or for a desired purpose, such as a fracking fluid, an acidizing fluid, steam, gel, foam or water.

Thus, in summary, in the third configuration the by-pass valve assembly 20 is in the down position and valve 21 is in the open position. The packer assembly 30 is in a set position with packing element(s) 32 compressed radially out against the inner wall of the completion string or casing. The anchor slip(s) 45 is also expanded to engage the inner wall of the completion string or casing to prevent undesired movement of the bottom hole assembly 10 during treatment. Further, the shift key(s) 56 has moved to a retracted position in the third configuration.

Figure 5:
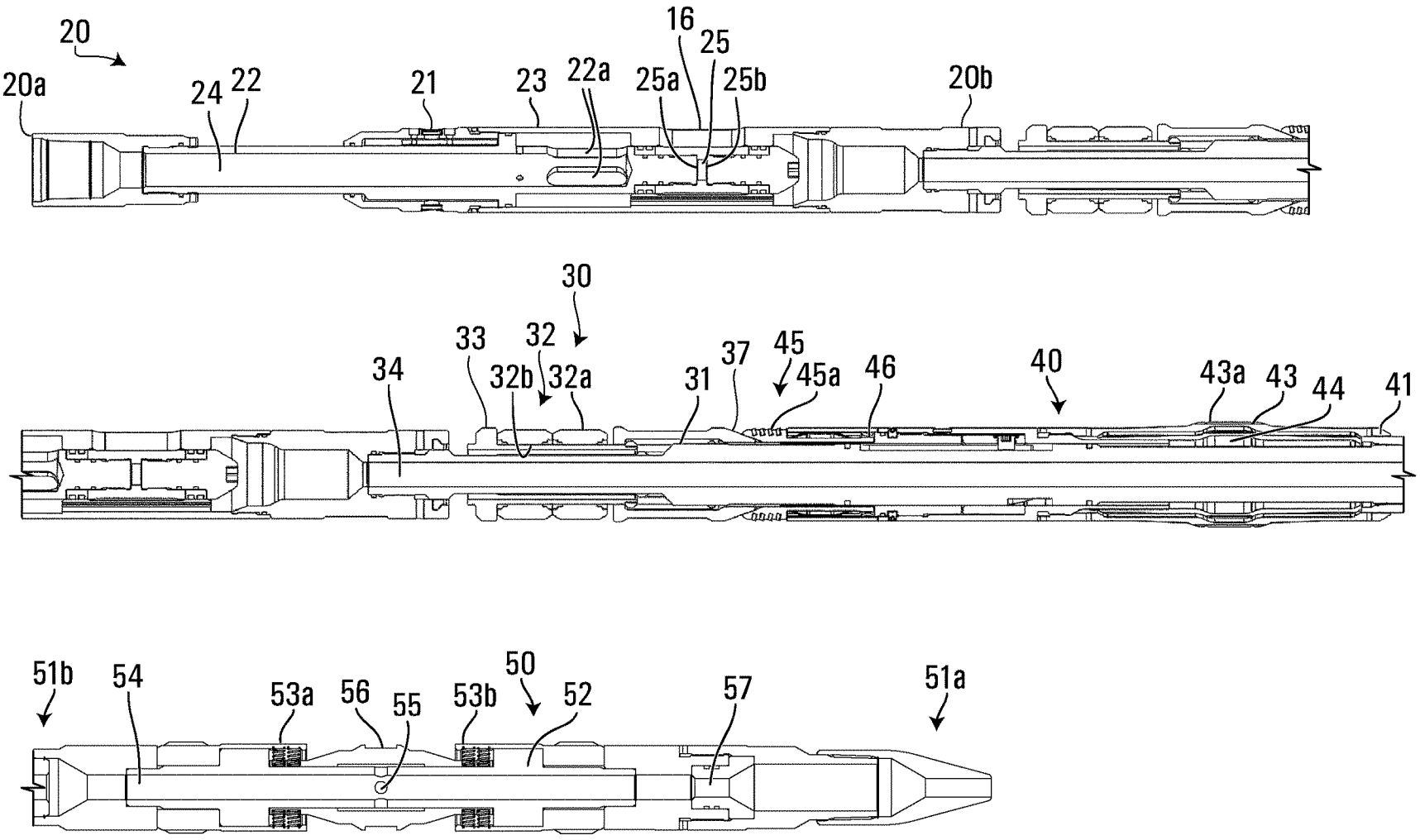
FIG. 5 depicts a pull out configuration of the bottom hole assembly.
Figure 10:
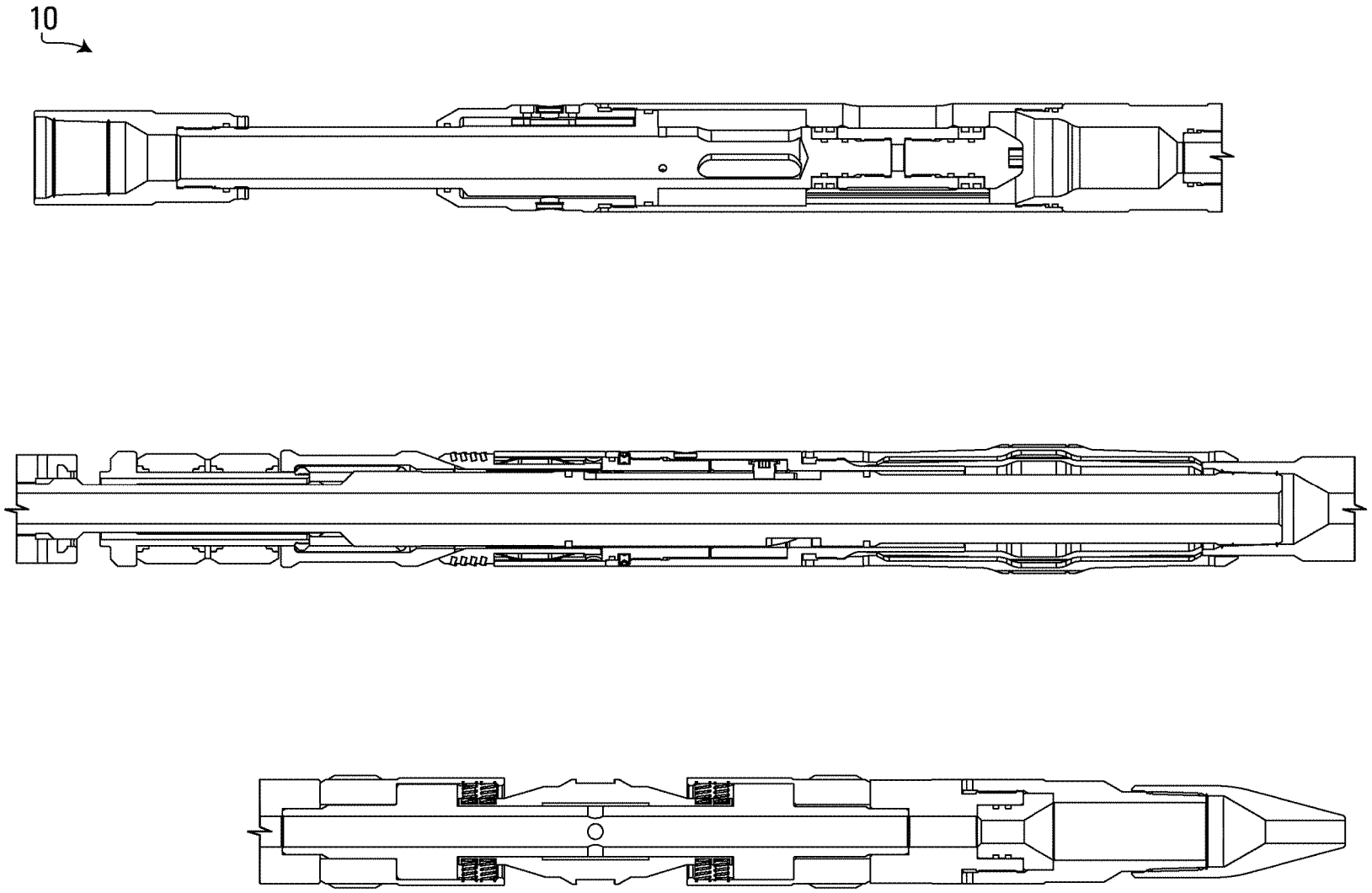
FIG. 10 depicts a pull out configuration of the bottom hole assembly of FIG. 1.

FIGS. 5 and 10 illustrate the bottom hole assembly 10 in the fourth (or pull out) configuration. Tension can applied to the bottom hole assembly 10 by pulling the tubing string up which breaks the seal between the packing element(s) 32, anchor slip(s) 45 and the completion string or casing to cause the pressure to equalize within the bottom hole assembly 10 subsequently causing the packing elements 32 and anchor slip(s) 45 to retract. The bottom hole assembly 10 may then be located at another well tool, such as a ported tubular, and may be moved through the second, third, and fourth configurations to open the ported tubular, set the packer assembly, treat the wellbore, and unset the packer assembly and release the bottom hole assembly from the ported tubular as discussed above.

In summary, in the fourth configuration the bypass valve assembly 20 is in the up position and valve 21 is in the closed position. The packer assembly 30 is in the unset position and the packing element(s) 32, anchor slip(s) 45 and the shift key(s) 56 are all in the retracted position. The bottom hole assembly 10 may then be moved from the first location to a second location within the wellbore to repeat the above progression for multiple treatments, if desired.

Figure 6:
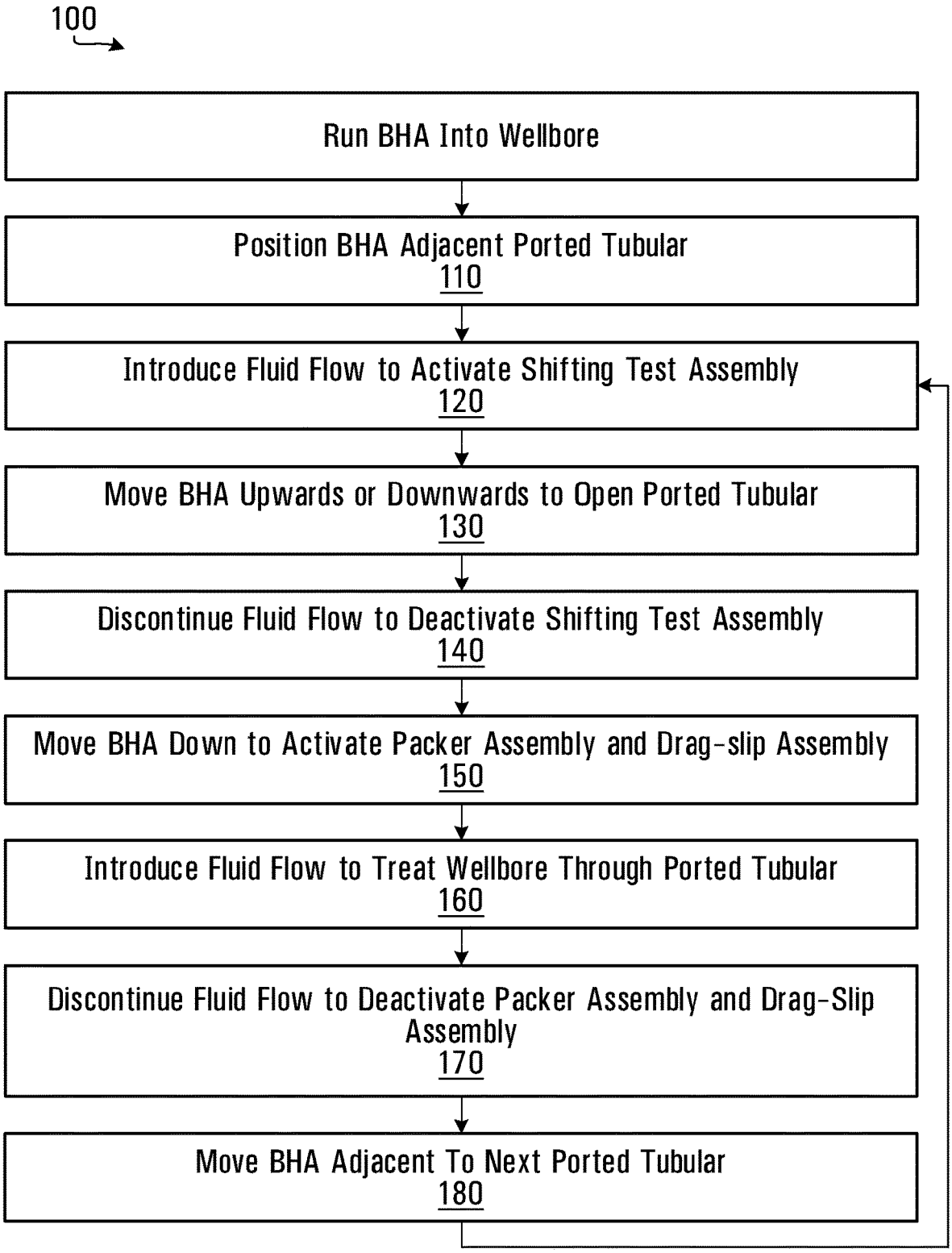
FIG. 6 depicts a flow chart of an embodiment of a method of treating a portion of a wellbore.

FIG. 6 illustrates a flow chart depicting a method 100 for treating a wellbore according to the present disclosure. A bottom hole assembly 10 according to the present disclosure is positioned adjacent at least one of a plurality of ported tubulars along a completion string or casing located within a wellbore, the ported tubulars having at least one closed port and which is configured to permit selective treatment of the wellbore at step 110. After positioning the bottom hole assembly 10 adjacent a ported tubular having at least one closed port at step 110, a first fluid is pumped down from the surface through a tubing string attached to the top of the bottom hole assembly to activate the shifting tool assembly and expand the one or more shift keys 56 and engage the ported tubular having at least one closed port at step 120. The first fluid can include, but is not limited to, an aqueous liquid.

The bottom hole assembly 10 is then moved upwards or downwards to shift the at least one closed port of the engaged ported tubular from a closed positon to an open position at step 130. Flow of the first fluid is stopped to deactivate the shifting tool assembly and retract the expanded shift key(s) at step 140. The bottom hole assembly 10 is then pushed down via the tubing string to set the packer assembly 30 and drag-slip assembly 40 and expand the one or more packing element(s) and one or more anchor slip(s) at step 150. A second fluid is pumped down from the surface through the tubing string and bottom hole assembly and the wellbore is treated through the opened port of the ported tubular at step 160. The second fluid can include, but is not limited to, any fluid that may be used in a subterranean application in conjunction with a desired function and/or for a desired purpose, such as a fracking fluid, an acidizing fluid, steam, gel, foam or water.

Flow of the second fluid is stopped and the bottom hole assembly is then pulled up via the tubing string to unset the packer assembly 30 and drag-slip assembly 40 and retract the packing element(s) 32 and anchor slip(s) 45 at step 170. The bottom hole assembly 10 is positioned at another ported tubular having one or more closed ports along the completion string or the casing at step 180. The method steps 120-180 can be repeated a plurality of times to open the one or more closed port(s) and treat the wellbore and position the bottom hole assembly at another ported tubular having one or more closed ports along the completion string or casing.

Accordingly, it is possible with the use of the bottom hole assembly of the present disclosure to shift and treat a well in a single trip by conducting the steps discussed above. The reduction in the number of trips needed to perform these procedures through utilization of the bottom hole assembly of the present disclosure will result in substantial savings of time and expense associated with evaluating exploration wells.

While the foregoing is directed to embodiment of the present disclosure, other and further embodiments of the disclosure may be devised without departing from the basic scope thereof, and the scope thereof is determined by the claims that follow.

The invention claimed is:

1. A bottom hole assembly adapted for connection to a tubing string, the bottom hole assembly comprising:

(a) a by-pass valve assembly comprising an up-hole end adapted for fluid communication with fluid flowing in a tubing string, a downhole end and a first flow passage extending between the up-hole end and the downhole end of the by-pass assembly, and further comprising at least one port for fluid communication between the first flow passage and an annular area exterior of the bottom hole assembly;

(b) a resettable sealing assembly positioned downhole of the by-pass valve assembly and comprising an up-hole end, a downhole end and a second flow passage there between; and (c) a shifting tool assembly positioned downhole of the resettable sealing assembly and comprising an up-hole end, a downhole end and a third flow passage there between;

wherein the by-pass valve assembly is operable to direct fluid flow in a first mode of operation and a second mode of operation;

wherein in said first mode of operation fluid flow is directed from the first flow passage to the annular area exterior of the bottom hole assembly through the port and is not directed from the first flow passage to the second flow passage in the resettable sealing assembly; and wherein in said second mode of operation fluid flow is prevented from flowing from the first flow passage to the annular area exterior of the bottom hole assembly through the port and is directed from the first flow passage to the second flow passage in the resettable sealing assembly.

2. The bottom hole assembly of claim 1, wherein the by-pass valve assembly further comprises a valve and a longitudinally sliding housing having one or more openings and a longitudinal central axial bore.

3. The bottom hole assembly of claim 2, wherein the by-pass valve further comprises an outer sleeve having one or more ports in its sidewall.

4. The bottom hole assembly of claim 2, wherein the by-pass valve assembly further comprises an annular channel.

5. The bottom hole assembly of claim 2, wherein the by-pass valve assembly further comprises a piston slidably positioned in the central axial bore.

6. The bottom hole assembly of claim 1, wherein the resettable sealing assembly comprises a packer assembly and a drag-slip assembly and wherein the packer assembly and the drag-slip assembly are configurable between an unset position and a set position.

7. The bottom hole assembly of claim 6, wherein the packer assembly comprises a housing and a longitudinal central axial bore.

8. The bottom hole assembly of claim 7, wherein the packer assembly further comprises a packing element annularly formed and encircling the housing of the packer.

9. The bottom hole assembly of claim 8, wherein the packing element has an outer facing surface and an inner facing surface, the outer facing surface and the inner facing surface operable to create a seal in a wellbore during the set position.

10. The bottom hole assembly of claim 9, wherein the packing element comprises an elastomeric material.

11. The bottom hole assembly of 8, wherein the packer assembly further comprises a compression collar annularly formed and encircling the housing of the packer.

12. The bottom hole assembly of claim 6, wherein the drag-slip assembly is mounted over the packer assembly and is configured to slide axially relative to the packer assembly.

13. The bottom hole assembly of claim 6, wherein the drag-slip assembly comprises a drag block biased radially outward by a spring and an anchor slip.

14. The bottom hole assembly of claim 1, wherein the shifting assembly further comprises a restriction nozzle.

15. The bottom hole assembly of claim 1, wherein the shifting tool assembly further comprises a shift key.

16. The bottom hole assembly of claim 15, wherein the shifting tool assembly further comprises an upper spring and a lower spring positioned on opposite ends of the shift key, the upper spring and the lower spring biased to hold the shift key in a retracted position.

17. The bottom hole assembly of claim 16, wherein the shifting tool assembly further comprises a housing having one or more openings and a longitudinal central axial bore.

18. The bottom hole assembly of claim 1, further comprising a mechanical collar locator.

19. A method for performing a wellbore operation with the bottom hole assembly of claim 1 coupled to and in fluid communication with a tubing string and located in a wellbore adjacent to a ported tubular having at least one open port comprising:

(a) moving the bottom hole assembly down by pushing on the tubing string to set the resettable sealing assembly to form a seal between an outer surface of the bottom hole assembly and an outer wall of the ported tubular; and (b) transferring a treatment fluid from the surface through the tubing string and through the port of the by-pass valve assembly to the opened port of the ported tubular to treat the wellbore.

20. The method of claim 19, wherein the treatment fluid comprises a fracking fluid, an acidizing fluid, steam, gel, foam or water.

* * * * *